US008479914B2

(12) United States Patent
Jones

(10) Patent No.: US 8,479,914 B2
(45) Date of Patent: Jul. 9, 2013

(54) SYSTEM AND METHOD FOR DISPENSING ADDITIVES TO A CONTAINER

(75) Inventor: Travis Alan Jones, Austin, TX (US)

(73) Assignee: Lidquids, LLC, Austin, TX (US)

( * ) Notice: Subject to any disclaimer, the term of this patent is extended or adjusted under 35 U.S.C. 154(b) by 25 days.

(21) Appl. No.: 13/107,477

(22) Filed: May 13, 2011

(65) Prior Publication Data

US 2012/0285985 A1 Nov. 15, 2012

(51) Int. Cl.
*B65D 25/08* (2006.01)

(52) U.S. Cl.
USPC ..... 206/219

(58) Field of Classification Search
USPC ..... 206/219–222; 215/227, 228; 366/130
See application file for complete search history.

(56) References Cited

U.S. PATENT DOCUMENTS

| | | | | |
|---|---|---|---|---|
| 3,415,360 | A * | 12/1968 | Baumann et al. | 206/222 |
| 3,655,035 | A * | 4/1972 | Muhlbauer | 206/219 |
| 3,762,540 | A * | 10/1973 | Baumann et al. | 206/219 |
| 3,841,467 | A * | 10/1974 | Hansen | 206/219 |
| 4,024,952 | A | 5/1977 | Leitz | |
| 5,509,530 | A * | 4/1996 | Wilson | 206/220 |
| 6,477,743 | B1 | 11/2002 | Gross et al. | |
| 6,609,612 | B2 | 8/2003 | Vlodek | |
| 6,854,595 | B2 | 2/2005 | Kiser | |
| 7,172,095 | B2 | 2/2007 | Marshall | |
| 7,337,921 | B2 | 3/2008 | Ma | |
| 7,568,576 | B2 | 8/2009 | Sweeney, Jr. et al. | |
| 7,588,142 | B1 | 9/2009 | Bush | |
| 7,748,550 | B2 | 7/2010 | Cho | |
| 7,823,723 | B2 | 11/2010 | Anthony et al. | |
| 2010/0258457 | A1 * | 10/2010 | Seelhofer | 206/222 |

* cited by examiner

*Primary Examiner* — Bryon Gehman

(74) *Attorney, Agent, or Firm* — Jackson Walker L.L.P.

(57) ABSTRACT

A method and system for liquid dispensing provides an additive to a base liquid in a container. The additive may be enclosed by an additive bladder that is contained in a container cap and supported by a retaining element having an additive dispensing hole. When the cap is screwed down, a concave element in the cap may press the additive bladder and dispense the additive.

7 Claims, 9 Drawing Sheets

SYSTEM AND METHOD FOR DISPENSING ADDITIVES TO A CONTAINER

BACKGROUND

1. Field of the Disclosure

The present disclosure relates to additive dispensing and, specifically, to dispensing of additives in a sealed container.

2. Description of the Related Art

Bottled containers are widely used to package and transport liquids, including beverages. In certain situations, it may be desirable to mix an additive to a base liquid. For example, a desired type of flavoring may be added to a base beverage, such as water. Various known methods for dispensing additives to liquid containers involve complex and customized mixing processes or bottle designs.

DESCRIPTION OF THE EMBODIMENT(S)

Figure 1A:
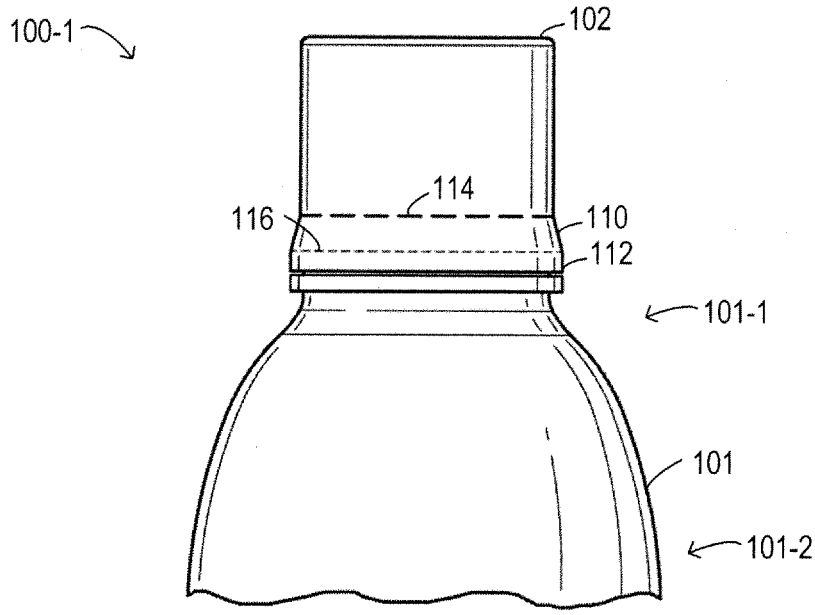
FIG. 1A is an external side view of selected elements of an embodiment of a liquid dispensing system.

In one aspect, a disclosed method for assembling an additive dispensing system includes filling a base liquid in a container having a threaded neck opening, placing a retaining element on the threaded neck opening, placing an additive bladder on the retaining element, the additive bladder including a portion of an additive enclosed by the additive bladder, and placing a removable cap for sealing the container over the retaining element and the additive bladder. The cap may include threads that rotatingly mate with the threaded neck opening, and a concave element configured to press the additive bladder against the retaining element.

In some embodiments, the method operation of placing the cap includes threading the cap against the threaded neck to form a cavity for accommodating the additive bladder between the retaining element and an interior surface of the cap. The cap may further include a sealing element for sealing the cavity. The interior surface of the cap may include the concave element. The retaining element may include an opening for dispensing the additive into the base liquid. In certain implementations, the additive dispensing system may be configured to enable dispensing of the additive into the base liquid by rotating the cap to press the concave element against the retaining element.

In one aspect, a contained system for dispensing additives includes a container for retaining a base liquid having a threaded neck opening, a retaining element in peripheral contact with the threaded neck opening and having an additive dispensing hole, and an additive bladder in contact with the retaining element, including a portion of an additive enclosed by the additive bladder. The system may also include a cap for sealing the container enclosing the retaining element and the additive bladder having threads that rotatingly mate with the threaded neck opening. The cap may include a sealing element for sealing a surface of the retaining element with respect to an interior surface of the cap and a concave element for pressing the additive bladder against the retaining element.

In some embodiments, upon rotation in a first angular direction, the cap may be configured to press the additive bladder against the retaining element in a closure direction, while the concave element presses against the bladder and the additive is released through the retaining element into the base liquid. Upon subsequent rotation in a second angular direction opposite the first angular direction, the cap may be configured to release the cap from the neck opening in an opening direction opposite the closure direction, while the retaining element and the empty bladder are retained in the cap.

In certain implementations, the system includes a spacer ring for securing the cap attached to an outer edge of the cap, while the spacer ring is configured to release upon rotation of the cap. A height of the spacer ring may correspond to at least a displacement of the cap sufficient to press substantially all of the additive from the additive bladder. The additive may be a liquid, a powder, a granulate, a paste, or a combination thereof. The additive bladder may be made of a material that substantially isolates the additive from the environment. The sealing element may be fixed to a circumferential edge of the retaining element.

In another aspect, a disclosed method for assembling an additive dispensing cap includes placing an additive in a cap for a container. The cap may include threads that rotatingly mate with a threaded neck opening of the container. The method may include placing a retaining element over the additive, wherein the retaining element is held in place between the threads and the additive. The method may further include providing a sealing element for sealing the retaining element with an interior surface of the cap. The cap may be configured to dispense the additive into the container through an opening in the retaining element when the cap is screwed on to the container.

In certain embodiments, the method may further include placing a concave element in the cap and providing the additive in an additive bladder. The cap may be configured to press the additive bladder between the retaining element and the concave element upon screwing on to the container.

In yet another aspect, a disclosed additive dispensing system includes a cap for sealing a liquid container having threads that rotatingly mates with a threaded neck opening of the liquid container. The system may include an additive bladder in contact with an inner surface of the cap and including a portion of an additive enclosed by the additive bladder, and a retaining element in contact with the additive bladder and having an additive dispensing hole. The retaining element may be held in place between the threads and the additive bladder. When the cap is screwed on to the liquid container, the cap may be configured to press the additive bladder between the retaining element and an interior surface of the cap, while the additive may be dispensed into the liquid container through the additive dispensing hole. The system may also include a concave element for pressing the additive bladder against the retaining element, while the interior surface of the cap is a surface of the concave element.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, for example, widget 12-1 refers to an instance of a widget class, which may be referred to collectively as widgets 12 and any one of which may be referred to generically as a widget 12.

Bottled containers are widely used to package, transport, and dispense various types of liquids. A "bottled container", or simply, "container", as used herein refers to a sealed container having a neck opening configured to receive a closure element. A container will generally be configured to stand upright and will enable dispensing of a liquid content through the neck opening by tilting the container sideways. A container may be formed in various shapes, including, but not limited to, cylindrical, spherical, prismatic, or a number of different types of regular and/or irregular shapes. In many cases, the closure element is a threaded cap that may be initially sealed, but may be configured for reuse, for example, resealing the container after a desired amount of the liquid content is dispensed. The neck opening, thus, may be configured with external threads that mate with the threads of the threaded cap.

In the discussion herein, containers suitable for storing and dispensing liquid beverages are described as exemplary embodiments for clarity. It is noted, however, that the scope of the present disclosure is not limited to beverages, but rather, extends to various types of liquid content and corresponding containers, and may include, for example, non-beverages, chemicals, chemical precursors, biological agents, mixtures, solutions, colloids, paints, solvents, and other types of industrial liquids in different embodiments. In certain embodiments, the liquid content may be in a fluid or a fluid-like state, such as a super fluid, a fluidized substance (e.g., a powder and/or other type of particulate), a gaseous substance, an aerosol, and/or various combinations thereof.

Turning now to the drawings, FIG. 1A is an external side view of selected elements of novel liquid dispensing system 100-1. Liquid dispensing system 100-1, as shown, includes container 101, which is shown having neck portion 101-1 that narrows from main body portion 101-2 to form a neck opening (obscured from view in FIG. 1A). It is noted that a lower enclosed portion of main body portion 101-2 has been obscured from view for improved presentation. Covering the neck opening (obscured from view) is cap 102, which is shown in FIG. 1A in a sealed (i.e., closed) configuration. Cap 102 is removably attached to spacer ring 110, which, as will be described in detail below, enables cap 102 to be rotated in either direction from the configuration shown in FIG. 1A. Cap 102 is configured with a cavity that contains an additive for mixing with a base liquid (elements obscured from view in FIG. 1A) stored in main body portion 101-2. Also shown in FIG. 1A is locking ring 112, which may include a retention mechanism (obscured from view in FIG. 1A) that enables locking ring 112 and spacer ring 110 to be held in place when cap 102 is turned, thereby enabling release of spacer ring 110 and/or locking ring 112 from cap 102. In certain embodiments, spacer ring 110 may be configured with perforation 114 with respect to cap 102 that is weaker than perforation 116 with respect to locking ring 112, such that perforation 114 is preferentially torn upon rotation of cap 102.

Figure 1B:
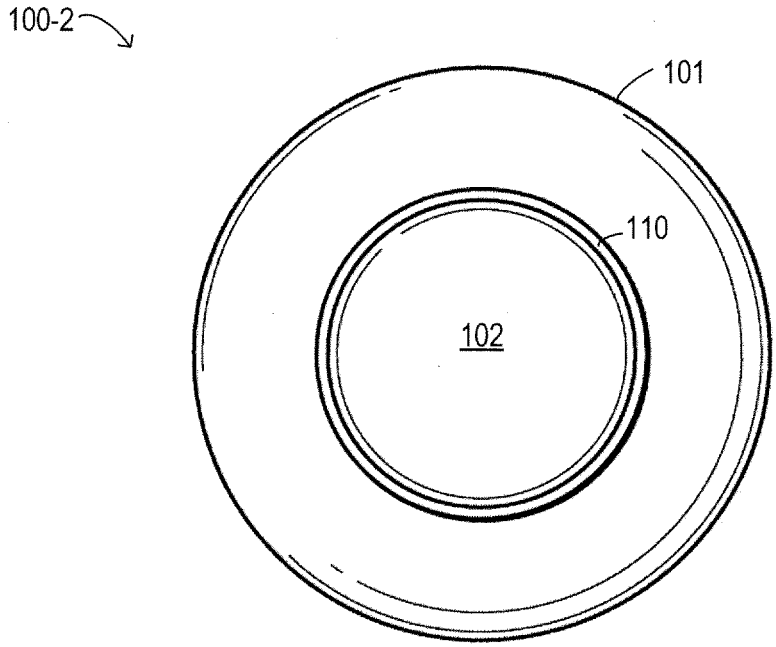
FIG. 1B is an external top view of selected elements of an embodiment of a liquid dispensing system.

In operation of liquid dispensing system 100-1, cap 102 may be rotated in a closure direction that directs cap 102 towards neck portion 101-1 and thereby releases spacer ring 110. At the same time cap 102 may cause the additive to be dispensed into the base liquid. In certain embodiments, the additive is included in an additive bladder that may be pressed, or squeezed by a concave element within cap 102, to release the additive. In other embodiments, the additive may be present in an additive chamber (obscured from view in FIG. 1A) within cap 102. Spacer ring 110 may correspond in height to a height of the additive chamber and/or the additive bladder, as will be described in further detail in the accompanying figures. It is noted that cap 102 may also be removed by rotating in an opening direction away from neck opening 101-1, either after dispensing of the additive, or without dispensing of the additive, to enable dispensing of liquid through the neck opening. FIG. 1B is an external top view of liquid dispensing system 100-2, in which container 101, spacer ring 110, and cap 102 are circularly formed. It is noted that container 101 may be formed in various shapes and geometries, as noted above, and yet still be configured with a circular neck opening for receiving cap 102.

Figure 2:
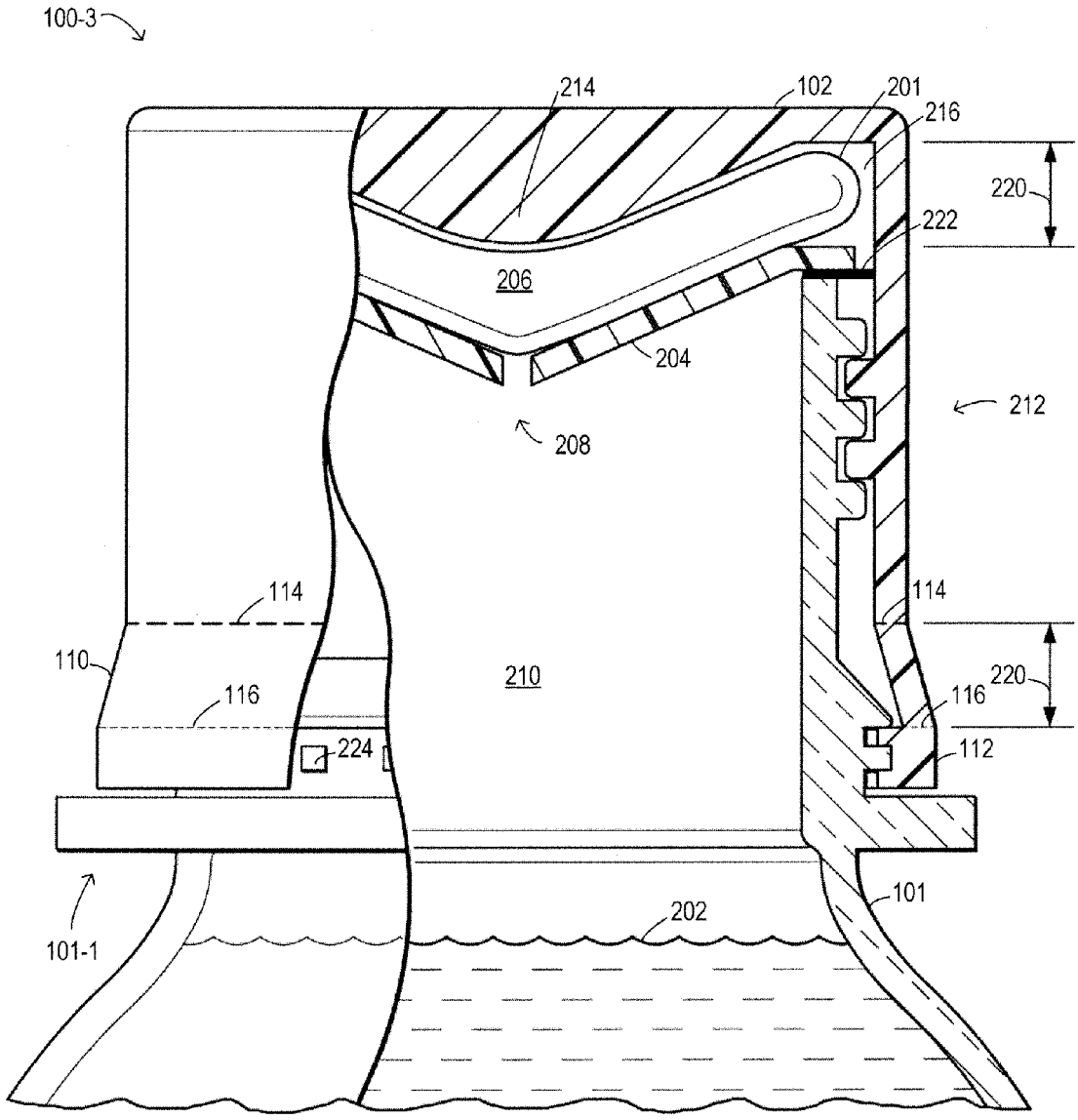
FIG. 2 is a cross-sectional view of selected elements of an embodiment of a liquid dispensing system.

Referring to FIG. 2, a cross-sectional view of selected elements of an embodiment of liquid dispensing system 100-3 is illustrated. It is noted that like numbered elements in FIG. 2 represent components discussed above with respect to FIGS. 1A-B. In liquid dispensing system 100-3, interior elements mentioned above with respect to FIG. 1A are now visible in partial cross-section. Container 101 is shown filled with base liquid 202, while void 210 represents a remainder of a volume content of container 101. It is noted that in various embodiments, void 210 may be filled with air or may be evacuated. When base liquid 202 includes a dissolved gas (e.g., carbon dioxide), void 210 may be pressurized to a vapor pressure of the dissolved gas when cap 102 seals container 101. Also visible in FIG. 2 is neck portion 101-1, which includes various structures for supporting cap 102, including threads in threaded portion 212 that mate with threads in cap 102. Spacer ring 110 is shown having vertical height 220, which is also the height of additive chamber 216 formed within cap 102. It is noted that vertical height 220 may vary, in different embodiments. Locking ring 112 is shown attached to spacer ring 110 via perforation 116, which, as mentioned above, may be stronger than perforation 114 attaching spacer ring 110 to cap 102. Also visible in FIG. 2 are detention elements 224, against which locking ring 112 may hold and provide a rotary detention when cap 102 is turned. It is noted that detention elements 224 and locking ring 112 may be configured to block rotation in a given direction, as desired.

Also shown in FIG. 2 is sealing element 222, which may provide a pressure seal to retain additive 206 within additive chamber 216, and prevent additive 206 from escaping through any other means except additive dispensing hole 208. In liquid dispensing system 100-3, sealing element 222 is depicted as a sealing ring that is placed between an upper lip of container 101 and retaining element 204, while also providing a seal with respect to an inside surface of cap 102. It is noted that other types of sealing elements and/or structures may be employed in different embodiments (see also FIGS. 3-4 and 7-8).

In FIG. 2, additive chamber 216 is shown as a cavity containing additive bladder 201, which encloses and seals additive 206. As noted previously, in certain embodiments, additive chamber 216 may contain additive 206 without additional structures. It is noted that additive bladder 201 may be made of various materials, including polymers, metals, and various types of composites, corresponding to desired physical properties. The thickness of additive bladder 201 may also vary, as desired, for a particular configuration of liquid dispensing system 100-3. Additive 206 may be any of a number of different types of materials, such as, but not limited to, a liquid, a powder, a granulate, a paste, or various combinations thereof. In one example embodiment, additive 206 may be a flavoring, a coloring, a thickener, or other dispensable ingredient, when base liquid 202 is a beverage, such as water.

As shown in FIG. 2, additive bladder 201 may be supported by retaining element 204, which may be a ring-shaped member supported by a top surface of neck portion 101-1 (i.e., the neck opening). Retaining element 204 may further be funnel-shaped and configured with additive dispensing hole 208. Concave element 214, which may form an interior surface of additive chamber 216, may be configured to press against additive bladder 201, and thereby cause additive 206 to be squeezed against retaining element 204 to the point of bursting. In this manner, additive 206 may be dispensed into base liquid 202 through additive dispensing hole 208, formed within retaining element 204 (see also FIG. 3). It is noted that the shape and/or profile of concave element 214 may vary according to additive bladder 201, additive 206, retaining element 204, and/or other factors, as desired for operation of liquid dispensing system 100-3. It is noted that in certain embodiments, concave element 214 may be a separate element that is introduced into cap 102 (see also FIGS. 5 and 6). In various embodiments, retaining element 204, concave element 214, and/or additive dispensing hole 208 may be circularly symmetrical.

Liquid dispensing system 100-3, as shown in FIG. 2, may provide for secure storage and separation of additive 206 and base liquid 202 in a state that is sealed from the environment. When blending of additive 206 with base liquid 202 is desired, cap 102 may be rotated in a closing direction (i.e., screwed down) to release spacer ring 110 and dispense additive 206. It is noted that the release of spacer ring 110 may enable cap 102 to be rotated in either direction and travel up or down with respect to neck portion 101-1. Cap 102 may then be removed by rotating in an opening direction to dispense liquid from container 101. Cap 102 may then be reused to seal container 101 after additive 206 has been dispensed and additive bladder 201 is substantially empty.

Figure 3:
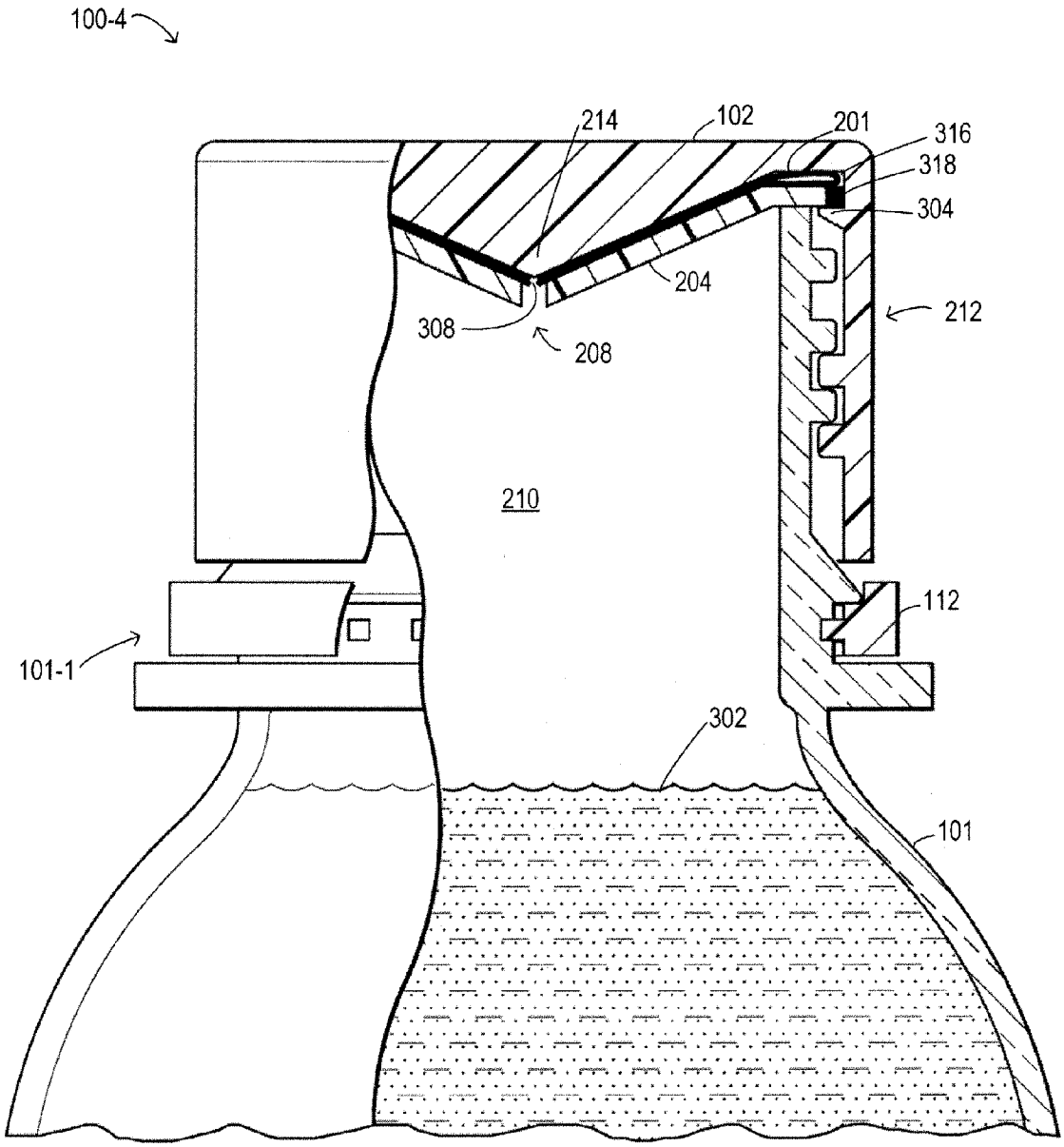
FIG. 3 is a cross-sectional view of selected elements of an embodiment of a liquid dispensing system.

Turning now to FIG. 3, a cross-sectional view of selected elements of an embodiment of liquid dispensing system 100-4 is illustrated. It is noted that like numbered elements in FIG. 3 represent components discussed above with respect to FIGS. 1A-B and 2, such as neck portion 101-1, threaded portion 212, and void 210. Liquid dispensing system 100-4 may represent a configuration of liquid dispensing system 100-3 after cap 102 has been screwed down and additive 206 has been dispensed into base liquid 202 (see FIG. 2). Accordingly, in FIG. 3, liquid 302 represents a blend of additive 206 and base liquid 202. Visible in FIG. 3 is locking ring 112, from which perforation 116 (see FIG. 2) has been separated. Absent in FIG. 3 is spacer ring 110, which may be removed after cap 102 is screwed down over vertical height 220 (see FIG. 2). It is noted that in liquid dispensing system 100-4 as shown, cap 102 may still seal container 101, even though spacer ring 110 has been separated from cap 102. In FIG. 3, additive chamber 316 has been reduced in size from vertical height 220 (see FIG. 2) after emptying additive bladder 201, which is now substantially devoid of additive 206. Concave element 214, shown in an exemplary configuration with angular surfaces, after impinging on additive bladder 201, has resulted in puncture 308 in additive bladder 201, through which additive 206 has been released through additive dispensing hole 208 in retaining element 204. Retaining element 204 may be fixed to cap 102 by means of retaining teeth 304, which may be formed within cap 102. Other methods of fixing retaining element 204 may also be realized in different embodiments. Also visible in FIG. 3 is sealing element 318, which is depicted as an exterior O-ring-type circumferential element affixed to an outer edge of retaining element 204. Thus, as in the embodiment shown in FIG. 3, sealing element 318 may provide a seal between retaining element 204 and an interior surface of cap 102, and may not be in contact with container 101. When cap 102 is removed, empty additive bladder 201 and retaining element 204 may thus be retained in cap 102.

Figure 4:
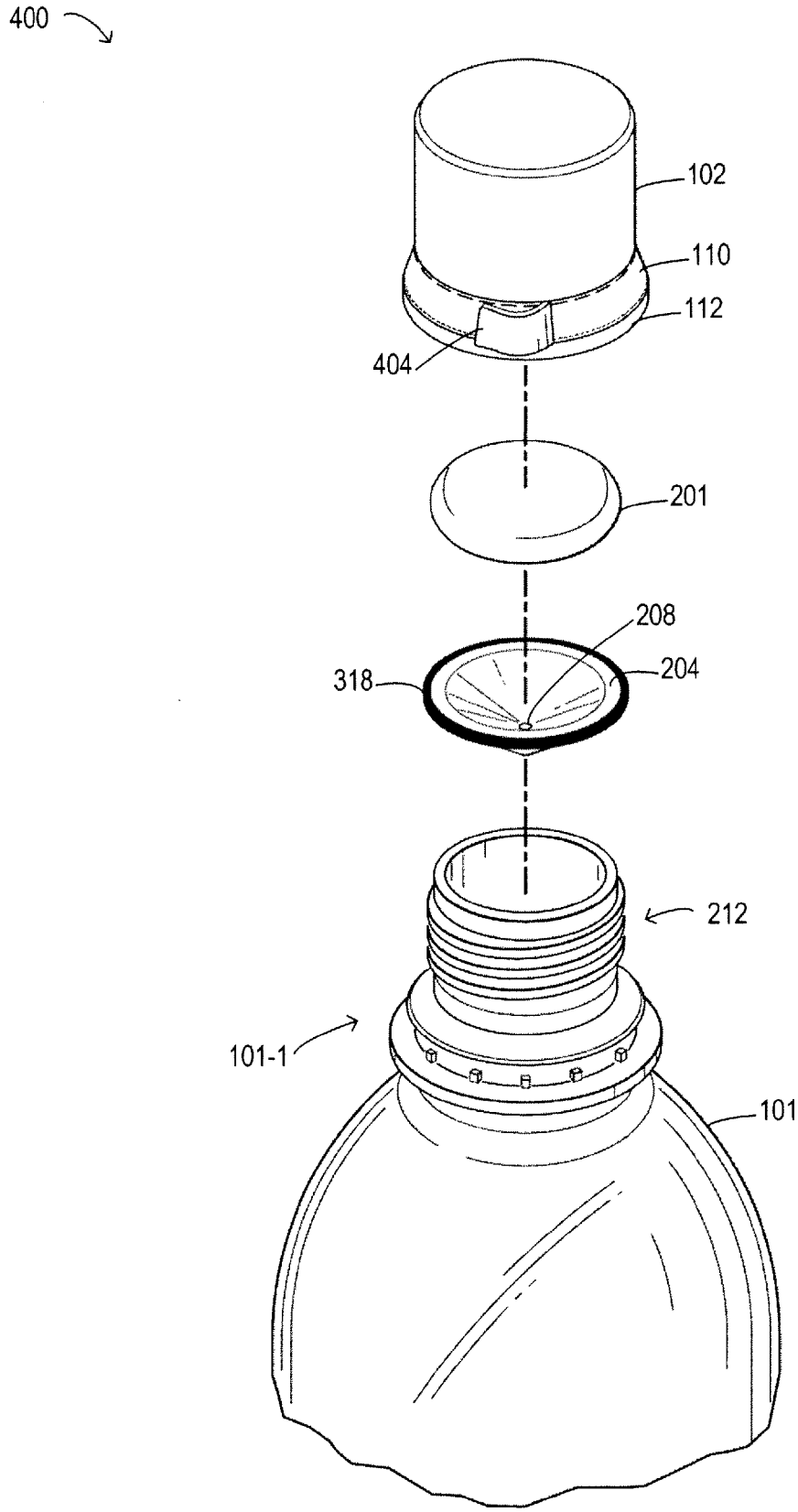
FIG. 4 is an exploded perspective view of selected elements of an embodiment of a liquid dispensing system.

Turning now to FIG. 4, an exploded perspective view of selected elements of an embodiment of liquid dispensing system 400 is illustrated. It is noted that like numbered elements in FIG. 4 represent components discussed above with respect to FIGS. 1A-B, 2, and 3. In FIG. 3, individual elements included in liquid dispensing system 400 are illustrated in suggestion of one embodiment of a method of assembly thereof. In some embodiments, novel liquid dispensing system 400 and a novel method of assembling liquid dispensing system 400 may be integrated into existing assembly methods and equipment (e.g., industrial bottling facilities) with relatively minor modifications. For example, after container 101 has been filled with base liquid 202 (not shown in FIG. 4, see FIG. 2), retaining element 204 may be placed on a top surface of neck portion 101-1 at the neck opening, such that additive dispensing hole 208 provides a passageway into container 101.

As shown in FIG. 4, retaining element 204 is equipped with sealing element 318. It is noted that in different embodiments, various types of sealing configurations may be implemented. For example, sealing element 222 (see FIG. 2) may be employed instead of, or in addition to, sealing element 318. Additive bladder 201 may then be placed upon retaining element 204. It is noted that additive bladder 201 may be manufactured and filled with additive 206 in a preliminary process (not shown), which may also provide significant economic and logistical advantages. Finally, cap 102, including spacer ring 110 and locking ring 112, may be secured to neck portion 101-1 at threaded portion 212. In the exemplary embodiment shown in FIG. 4, spacer ring 110 is shown including removal tab 404, which may provide for manual removal of spacer ring 110, as desired.

Figure 5:
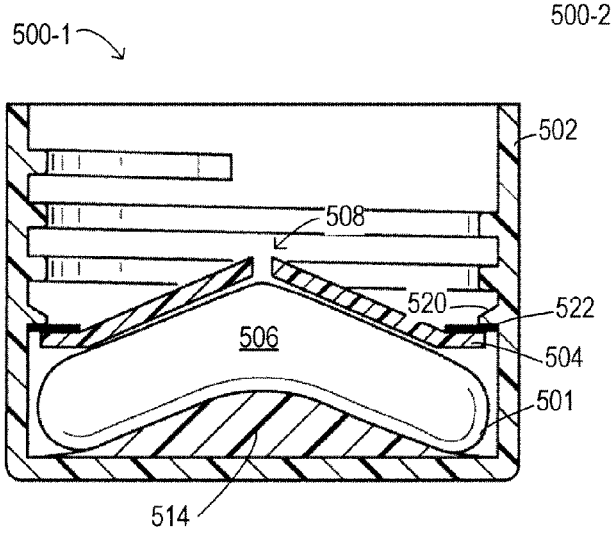
FIG. 5 is a cross-sectional view of selected elements of an embodiment of a liquid dispensing system.
Figure 6:
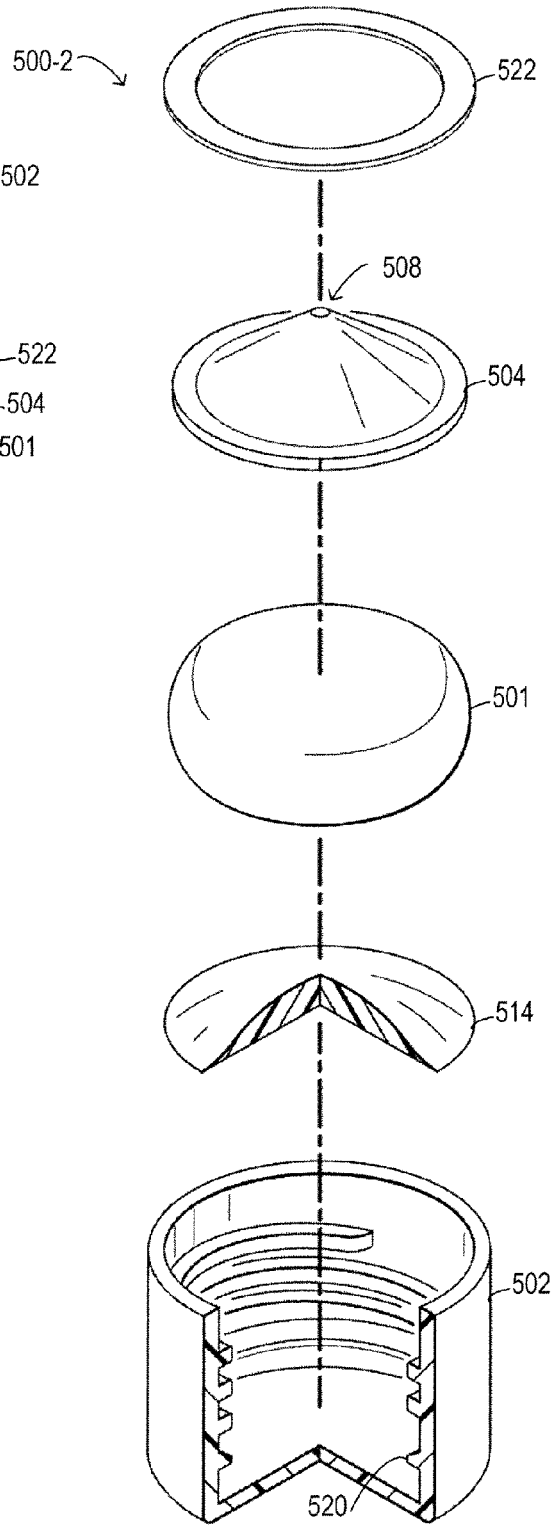
FIG. 6 is an exploded perspective view of selected elements of an embodiment of a liquid dispensing system.

Turning now to FIG. 5, a cross-sectional view of selected elements of an embodiment of liquid dispensing system 500-1 is illustrated. Liquid dispensing system 500, as illustrated in FIGS. 5 and 6, may represent an embodiment that is configured independently of container 101 (see FIGS. 1-4) and may be used with different instances of container 101. For example, liquid dispensing system 500 may be sold separately from container 101 to provide a variety of additive 506 selections for a consumer of container 101. Liquid dispensing system 500-1, as shown, includes cap 502, which may be substantially similar to cap 102, described above with respect to FIGS. 1-4. It is noted that cap 502 may include spacer ring 110 and/or locking ring 112 (not shown in FIG. 5) in certain embodiments. Cap 502 may contain additive bladder 501, which encloses a portion of additive 506. Additive bladder 501 may be substantially similar to additive bladder 201, as described previously herein. Cap 502 may further contain concave element 514, which is shown as a removable element in FIG. 5. Also included with liquid dispensing system 500-1 may be retaining element 504 having additive dispensing hole 508, which may be substantially similar to retaining element 204 and additive dispensing hole 208, described previously. As shown in FIG. 5, sealing element 522 provides a seal between retaining element 504 and an interior surface of cap 502, and optionally may seal an upper lip of container 101 (not shown in FIG. 5). Retaining element 504 and/or sealing element 522 may be held in place by retention tooth 520 formed within cap 502.

Turning now to FIG. 6, an exploded perspective view of selected elements of an embodiment of liquid dispensing system 500-2 is illustrated. It is noted that like numbered elements in FIG. 6 represent components discussed above with respect to FIG. 5. In FIG. 6, individual elements included in liquid dispensing system 500-2 are illustrated in suggestion of one embodiment of a method of assembly thereof. It is noted that the orientation of liquid dispensing system 500 depicted in FIGS. 5 and 6 is arbitrary and may be adapted in various embodiments. Cap 502 forming an interior cavity may be provided. Concave element 514 may be placed into the interior cavity and form a surface of the interior cavity. Additive bladder 501 may be placed in the interior cavity of cap 502. Retaining element 504, having additive dispensing hole 508, may be placed over additive bladder 501 and may be held in place between the threads of cap 502 and additive bladder 501. Sealing element 522 may then be placed above retaining element 504 by retention tooth 520. It is noted that another type of sealing element, such as an exterior O-ring-type circumferential element (see FIG. 3, sealing element 318), may be used in addition to or instead of sealing element 522 in different embodiments. Liquid dispensing system 500 may then be packaged and sold.

Figure 7:
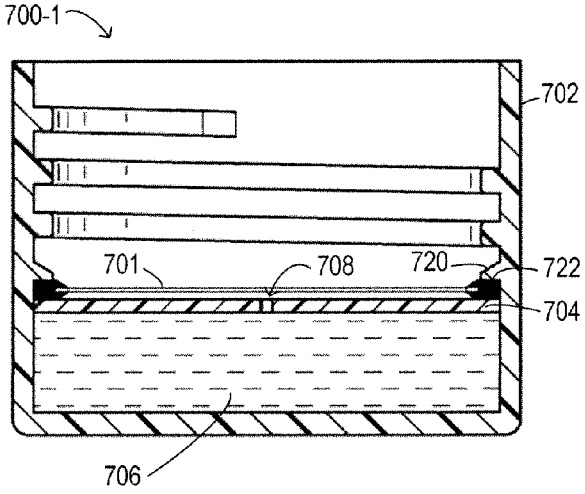
FIG. 7 is a cross-sectional view of selected elements of an embodiment of a liquid dispensing system.
Figure 8:
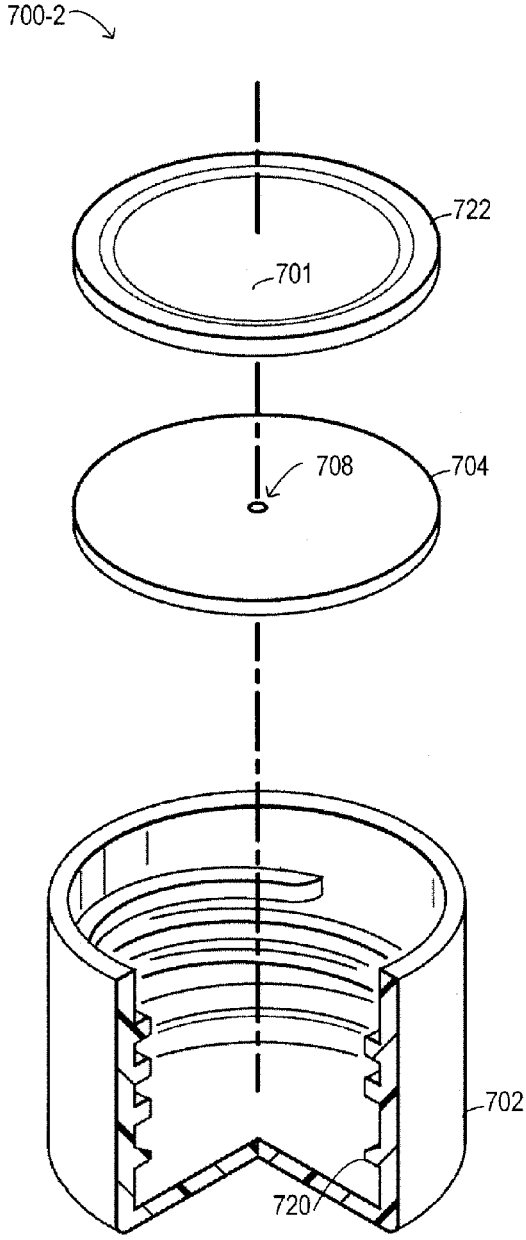
FIG. 8 is an exploded perspective view of selected elements of an embodiment of a liquid dispensing system.

Turning now to FIG. 7, a cross-sectional view of selected elements of an embodiment of liquid dispensing system 700-1 is illustrated. Liquid dispensing system 700, as shown in FIGS. 7 and 8, may represent an embodiment that is configured independently of container 101 (see FIGS. 1-4) and may be used with different instances of container 101. For example, liquid dispensing system 700 may be sold separately from container 101 to provide a variety of additive 706 selections for a consumer of container 101. Liquid dispensing system 700-1, as shown, includes cap 702, which may be substantially similar to cap 102, described above with respect to FIGS. 1-4. It is noted that cap 702 may include spacer ring 110 and/or locking ring 112 (not shown in FIG. 7) in certain embodiments. Cap 702 may be configured to receive a portion of additive 706. Also included with liquid dispensing system 700 may be retaining element 704 having additive dispensing hole 708. Additive dispensing hole 708 may also be used to fill additive 706 in cap 702, for example, by injection with a needle or similar structure (not shown in FIG. 7). As shown in FIG. 7, sealing element 722 provides a seal between retaining element 704 and an interior surface of cap 702, and optionally may seal an upper lip of container 101 (not shown in FIG. 7). Sealing element 722 may be formed as a circumferential element that includes bladder membrane 701, which may be a central portion that is thinner and configured to rupture under pressure. Retaining element 704 and/or sealing element 722 may be held in place by retention tooth 720 formed within cap 702.

Turning now to FIG. 8, an exploded perspective view of selected elements of an embodiment of liquid dispensing system 700-2 is illustrated. It is noted that like numbered elements in FIG. 8 represent components discussed above with respect to FIG. 7. In FIG. 8, individual elements included in liquid dispensing system 700-2 are illustrated in suggestion of one embodiment of a method of assembly thereof. It is noted that the orientation of liquid dispensing system 700 depicted in FIGS. 7 and 8 is arbitrary and may be adapted in various embodiments. Cap 702 forming an interior cavity may be provided. Retaining element 704, having additive dispensing hole 708, may be placed in cap 702. It is noted that additive 706 (not shown in FIG. 8, see FIG. 7) may be added prior to or after insertion of retaining element 704. Sealing element 722, having bladder membrane 701, may then be placed above retaining element 704 by retention tooth 720. Liquid dispensing system 700 may then be packaged and sold.

Figure 9:
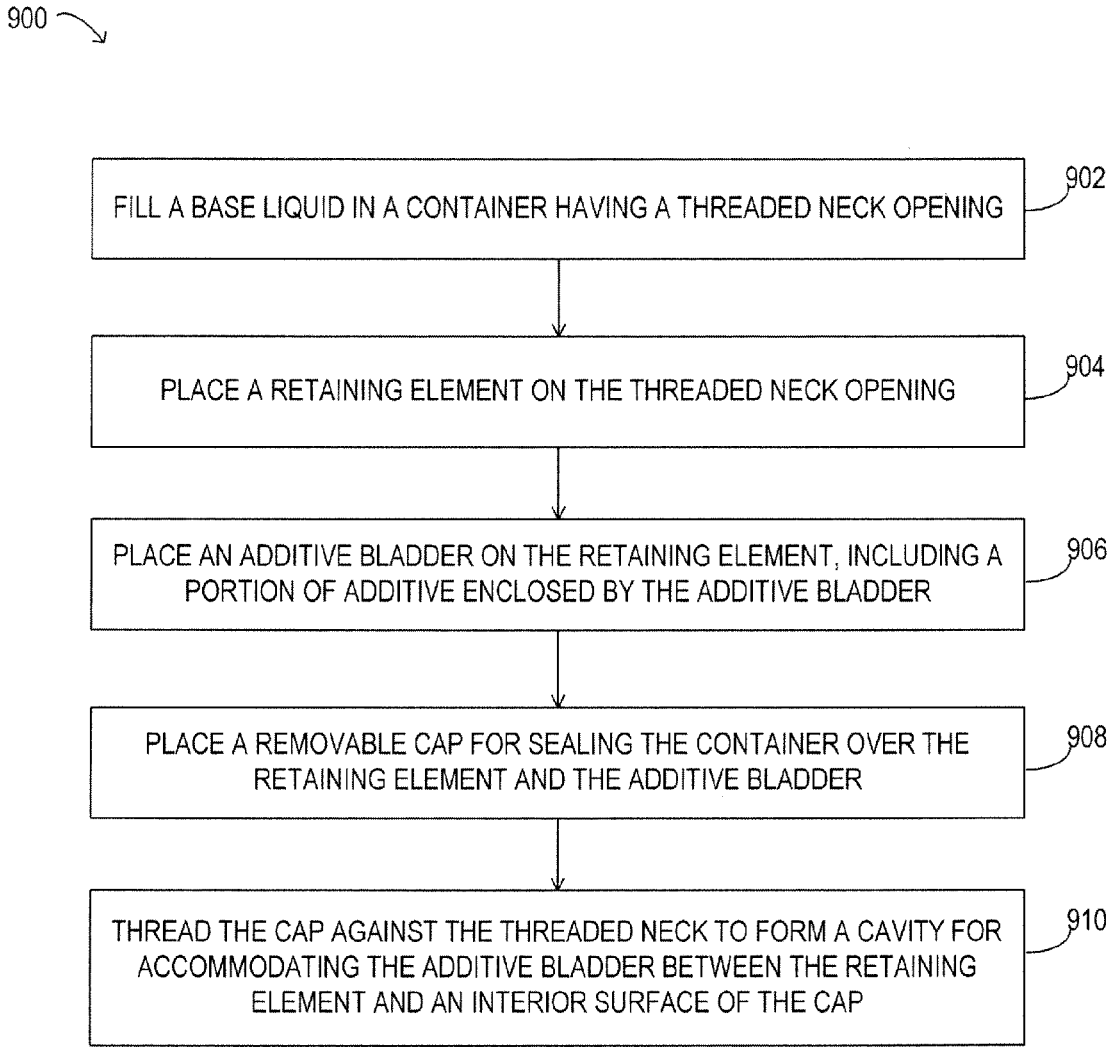
FIG. 9 is a block diagram of selected elements of an embodiment of a process for assembling a liquid dispensing system.

Turning now to FIG. 9, a block diagram of selected elements of an embodiment of method 900 for assembling a liquid dispensing system is depicted in flow-chart form. Method 900 may represent a method for assembling liquid dispensing system 100, in various embodiments. It is noted that certain operations described in method 900 may be optional or may be rearranged in different embodiments.

Method 900 may begin by filling (operation 902) a base liquid in a container having a threaded neck opening. The container may be a beverage container, such as a bottle. A retaining element may be placed (operation 904) on the threaded neck opening. The retaining element may include an additive dispensing hole for dispensing an additive into the base liquid. An additive bladder enclosing a portion of additive may be placed (operation 906) on the retaining element. A removable cap for sealing the container may be placed (operation 908) over the retaining element and the additive bladder. The cap may be configured with threads that rotatingly mate with the threaded neck opening. The cap may include a puncture element for puncturing the additive bladder. The cap may be threaded (operation 910) against the threaded neck to form a cavity for accommodating the additive bladder between the retaining element and an interior surface of the cap. The interior surface of the cap may include the additive bladder.

Figure 10:
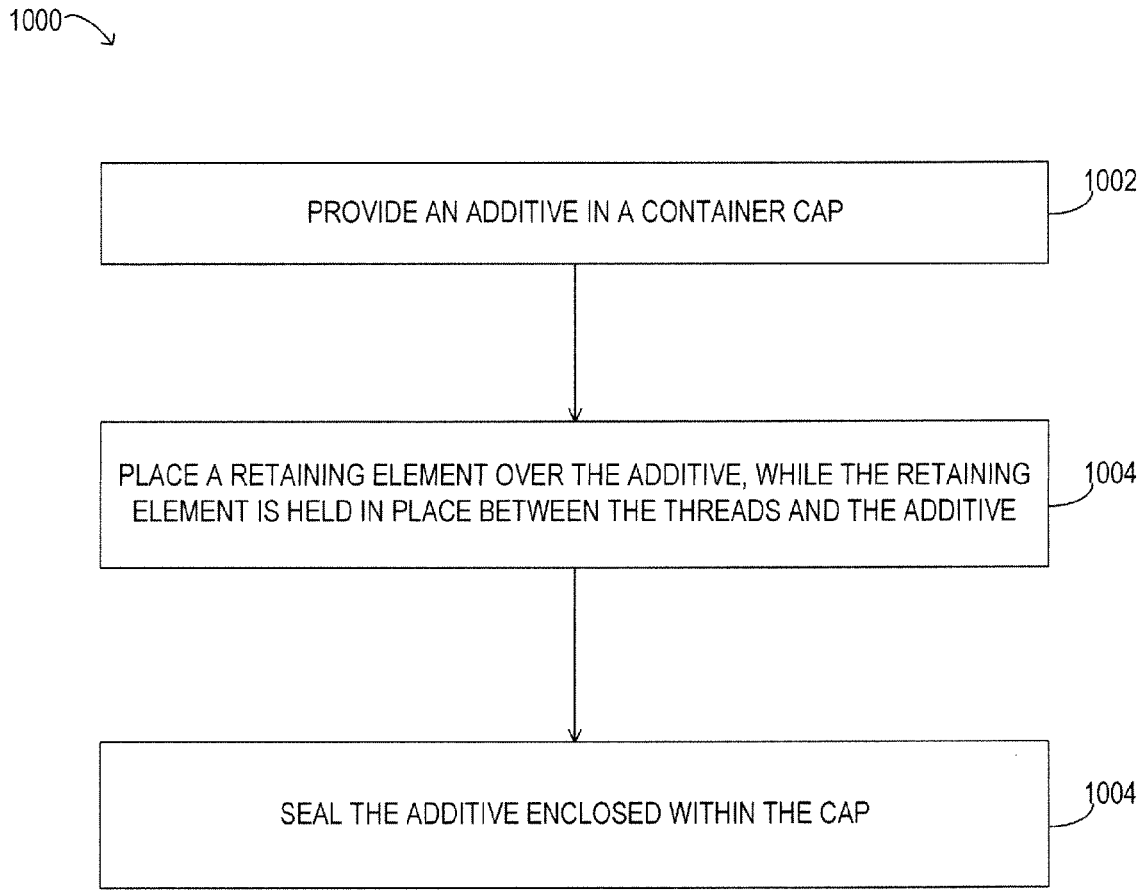
FIG. 10 is a block diagram of selected elements of an embodiment of a process for assembling a liquid dispensing system.

Turning now to FIG. 10, a block diagram of selected elements of an embodiment of method 1000 for assembling a liquid dispensing system is depicted in flow-chart form. Method 1000 may represent a method for assembling liquid dispensing system 500, in various embodiments. It is noted that certain operations described in method 1000 may be optional or may be rearranged in different embodiments. Method 1000 may begin by providing (operation 1002) an additive in a container cap. The additive may be provided enclosed in an additive bladder. A retaining element may be placed (operation 1004) over the additive, while the retaining element is held in place between the threads and the additive. The additive enclosed in the cap may then be sealed (operation 1006). The seal may be an internal sealing element in contact with an internal surface of the cap. In certain embodiments, an external seal, such as a shrink wrapping of the cap, may be used.

Figure 11:
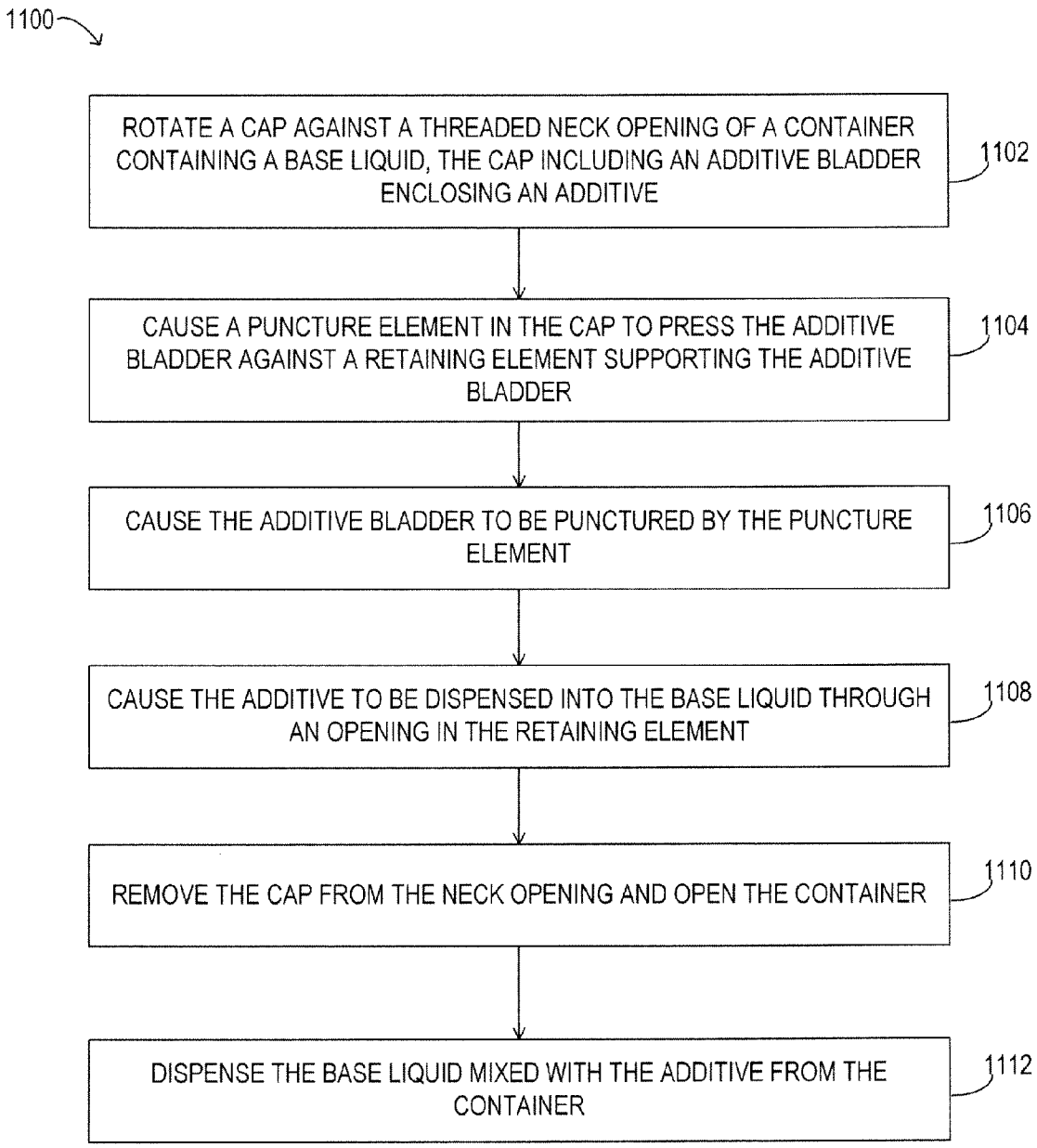
FIG. 11 is a block diagram of selected elements of an embodiment of a liquid dispensing process.

Turning now to FIG. 11, a block diagram of selected elements of an embodiment of method 1100 for operating a liquid dispensing system according to the methods described herein is depicted in flow-chart form. Method 1100 may represent a method for operating liquid dispensing system 100 and/or 500, in various embodiments.

Method 1100 may begin by rotating (operation 1102) a cap, which includes an additive bladder enclosing an additive, against a threaded neck of a container containing a base liquid. The cap may be rotated in a closing direction. As a result of operation 1102, a puncture element in the cap may be caused (operation 1104) to press the additive bladder against a retaining element supporting the additive bladder. Operation 1102 may then cause (operation 1106) the additive bladder to be punctured by the puncture element. Operation 1102 may then cause (operation 1108) the additive to be dispensed into the base liquid through an additive dispensing hole in the retaining element. The cap may then be removed (operation 1110) from the neck opening and the container may be opened. The empty bladder and the retaining element may be retained in the cap. The base liquid mixed with the additive may be dispensed (operation 1112) from the container.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A system for dispensing additives comprising:

a container for retaining a base liquid having a threaded neck opening;

a retaining element in peripheral contact with the threaded neck opening and having an additive dispensing hole;

an additive bladder in contact with the retaining element, including a portion of an additive enclosed by the additive bladder;

a cap for sealing the container enclosing the retaining element and the additive bladder having threads that rotatingly mate with the threaded neck opening;

a sealing element for sealing a surface of the retaining element with respect to an interior surface of the cap;

a concave element for pressing the additive bladder against the retaining element; and a spacer ring for securing the cap attached to an outer edge of the cap, wherein a height of the spacer ring corresponds to at least a displacement of the cap sufficient to press substantially all of the additive from the additive bladder;

wherein the cap is configured to:

upon rotation in a first angular direction, press the additive bladder against the retaining element in a closure direction, wherein the concave element presses against the additive bladder and the additive is released through the retaining element into the base liquid.

2. The system of claim 1, wherein the cap is configured to:

upon subsequent rotation in a second angular direction opposite the first angular direction, release from the threaded neck opening in an opening direction opposite the closure direction, wherein the retaining element and the additive bladder are retained in the cap.

3. The system of claim 1, wherein the spacer ring is also attached to a locking ring, and wherein the spacer ring is configured to preferentially release from the cap upon rotation of the cap.

4. The system of claim 1, wherein the sealing element is fixed to a circumferential edge of the retaining element.

5. The system of claim 1, wherein the additive bladder is made of a material that substantially isolates the additive from the environment.

6. The system of claim 1, wherein the additive is at least one of: a liquid, a powder, a granulate, and a paste.

7. The system of claim 1, wherein the interior surface of the cap is a surface of the concave element.

* * * * *